United States Patent [19]

Minowa

[11] 4,175,488

[45] Nov. 27, 1979

[54] PRINTER

[75] Inventor: Masahiro Minowa, Shiojiri, Japan

[73] Assignee: Kabushiki Kaisha Suwa Seikosha, Tokyo, Japan

[21] Appl. No.: 685,582

[22] Filed: May 12, 1976

Related U.S. Application Data

[63] Continuation of Ser. No. 483,753, Jun. 27, 1974, abandoned.

[30] Foreign Application Priority Data

Jun. 27, 1973 [JP] Japan ..... 48-72422

[51] Int. Cl.[2] ..... B41J 1/44

[52] U.S. Cl. ..... 101/99; 101/93.22; 101/110

[58] Field of Search ..... 101/110, 99, 95, 93.37, 101/93.41, 93.42, 93.43; 235/61.9, 60 P

[56] References Cited

U.S. PATENT DOCUMENTS

| | | | |
|---|---|---|---|
| 3,148,616 | 9/1964 | Miesiak | 101/110 |
| 3,673,574 | 10/1971 | Longcoy | 101/110 X |
| 3,731,622 | 5/1973 | Baranoff | 101/110 X |
| 3,838,638 | 10/1974 | Clary | 101/99 X |

*Primary Examiner*—Edward M. Coven

*Attorney, Agent, or Firm*—Blum, Kaplan, Friedman, Silberman and Beran

[57] ABSTRACT

A printer having a print command circuit adapted to provide a print command signal, to thereby begin each print cycle is provided. The printer further includes a character ring having print characters circumferentially positioned therearound, each print character being selectively positioned by rotating the character ring from a rest position to a print position in response to the print command signal. The improvement comprises a single position detection circuit for generating character selection timing pulses representative of each rotational position of the character ring and being further adapted to produce return timing pulses in response to the opposite rotation of the character ring when same is returned to its rest position. Improved circuitry is provided for sensing the last pulse of said return timing pulses, utilizing same to supply a print-off pulse to the print command circuit to indicate the completion of the print cycle.

4 Claims, 5 Drawing Figures

PRINTER

This is a continuation, of application Ser. No. 483,753, filed June 27, 1974, now abandoned.

BACKGROUND OF THE INVENTION

This invention relates to parallel printers and in particular to an improved parallel printer wherein timing pulses generated by a photo detection circuit are utilized to provide a print-off signal to the print command circuit to indicate completion of the print cycle.

Although printers utilizing selectively rotated character rings wherein the print characters disposed thereon are selectively rotated to a print position in response to a print command signal are well known, such printers have been less than completely satisfactory. In order to insure that the print-off signal is not applied until the character ring has been sufficiently rotated toward the rest position so that the next print cycle can be commenced, it is necessary to apply a print-off signal to the print command circuit. Accordingly, photo detection circuits, reed switches, microswitches, etc. have been utilized to provide a print-off signal to the print command circuit. The inclusion of such signal generating mechanisms is both complicated and costly. One attempt to overcome this problem has been the use of mono-stable multivibrators adapted to apply a print-off signal at a certain time interval after the print command signal has begun the print cycle. However, in order to utilize the mono-stable multivibrator effectively, the time interval must be for the worst condition, taking into account such variations as the ambient temperature and mechanical and electrical delays. Thus, such a method reduces the amount of printed lines per unit of time by increasing the time of each print cycle hence decreasing the cost of the printing operation.

SUMMARY OF THE INVENTION

Generally speaking, in accordance with the invention, a parallel printer is provided wherein the last pulse of the timing signals generated during the return cycle of the character rings by the timing signal photo detection circuit also utilized for supplying timing signals to a character counter is used to supply a print-off pulse. The printer includes a print command circuit adapted to provide a print command signal to begin a print cycle, the printer further including a character ring having print characters circumferentially disposed thereabout, the print characters being selectively rotated into a print position by rotation of said character ring in a first rotational direction from a rest position to a print position in response to the print command signal. A single photo detection circuit is provided for generating character selection timing pulses representative of each rotational position of said character ring, said photo detection circuit being further adapted to produce a second plurality of return timing pulses in response to the rotation of said character ring in a second rotational direction from said print position to its said rest position. A circuit is provided for sensing the last pulse of said return timing signals and in response thereto supplying a print-off pulse to said print command circuit to indicate the completion of the printing cycle.

Accordingly, it is an object of this invention to provide an improved printer wherein the timing signals generated by the photo detector are also utilized to generate a print-off signal.

Another object of this invention is to provide an improved and simplified printer wherein the cost of manufacturing same is reduced.

It is still another object of this invention to provide an improved printer wherein a print-off signal is generated in response to the rotary position of the character ring and, hence is not affected by the variations in the movement caused by the variations in the mechanism's operation and the effects of the ambient temperatures therearound.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
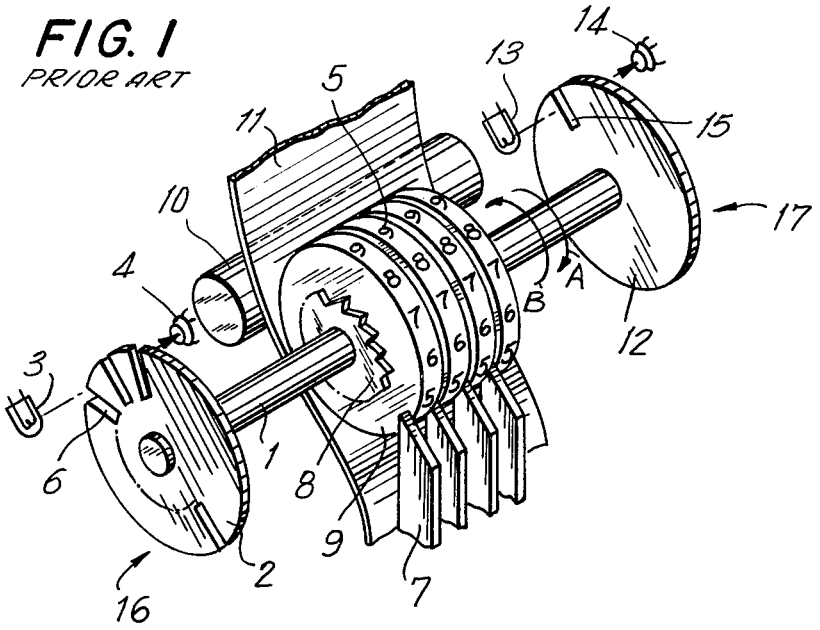
FIG. 1 PRIOR ART
FIG. 1 is a perspective view of a printer constructed in accordance with the prior art.
Figure 2:
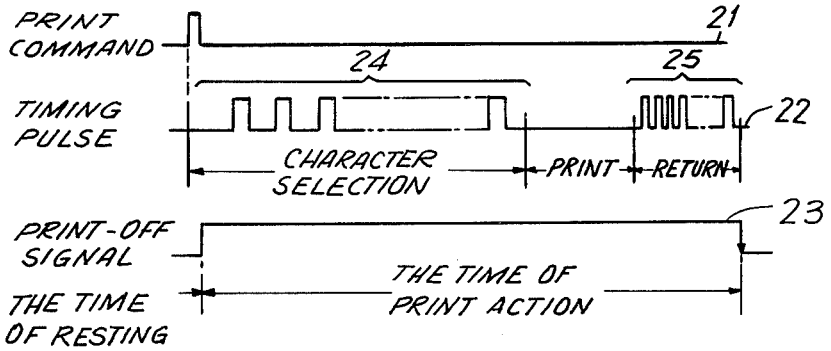
FIG. 2 PRIOR ART
FIG. 2 is a wave diagram of the signals generated during complete print cycle of the prior art printer depicted in FIG. 1.

Reference is now made to FIGS. 1 and 2 wherein a printer constructed in accordance with the prior art, and the signals for effecting a complete print cycle thereof are respectively depicted. The printer includes a plurality of character rings 9 mounted to a rotating character shaft 1. Print characters representative of characters, numbers, symbols or the like are circumferentially disposed about the periphery of each character ring 9. Each character ring 9 includes a ratchet gear mounted to or integrally formed on the side of the character rings 9, each ratchet gear is adapted to be operatively engaged by a pawl 7 to prevent rotation of the character ring associated therewith. Each ratchet gear tooth aligned with a certain character in order to effect a selective positioning of the character in facing relationship with the print hammer 10. The ratchet and pawl mechanism on each of the character rings is rendered operative by electromagnets (not shown) associated with each pawl. The character shaft 1 is adapted to be rotated in a first rotational direction to begin the character selection by a motor (not shown), to begin the character selection phase of the print cycle. Also, a spring (not shown) causes the character shaft 1 to be returned to a rest position during the return phase of the print cycle by rotating the shaft in an opposite direction.

At a first end of the character ring shaft 1 is a character selection photo detection assembly, generally indicated at 16, which detects the position of the character shaft 1 and in response thereto generates character positioning signals which are hereinafter discussed. A print-off photo detection assembly generally indicated as 17, is disposed on the other end of the character shaft 1 and includes detection plate 12 having a slit 15 formed therein, a light emitting lamp 13 and light receiving detector 14, adapted to cooperate with the detecting plate 12 and light emitting lamp 13 to generate a print-off signal in response thereto.

In operation, the print cycle is commenced whereby the character selection phase begins with the character shaft 1 being rotated in a first rotational direction, indicated by arrow A. Character selection timing pulses are generated by the photo detection assembly 16 in response to the rotation of character shaft 1 and are provided to a character counter (not shown). The character counter determines position of the print character to be selected and in response thereto provides a signal to cause the pawl to engage with the ratchet wheel on the character ring, to stop the rotation thereof. The selected character thereby is disposed in facing relationship with print hammer 10. Accordingly, printing is effected by striking the print hammer against the print character with the paper disposed therebetween. Upon completion of the printing phase of the cycle, the return phase of the cycle is begun and the spring rotates the character shaft in the opposite rotational direction, indicated by arrow B. Accordingly character shaft 1 is rotated until the character rings 9 are rotated into a rest position.

Upon return of the print character rings to a rest position, a print-off signal is applied to the print command circuit (not shown) by the photo detector assembly 17 to indicate the completion of the print cycle. The operation of the pawls 7 is generally in response to a comparison between the output of the character counter and control signals from a calculator, measuring instrument, or the like. Also, in certain prior art printers the character counter is reset by the print-off signal and begins counting coincident with the application of the print command signal at the beginning of the next print cycle.

As is particularly illustrated in FIG. 2, upon application of the print command pulse, the print cycle begins and the character shaft begins rotation in order to select the character to be printed. In response to the character selection rotation of the shaft, timing pulses 24 are generated by the character selection photo detection assembly 16. When the spring quickly rotates the character shaft back to the rest position during the return phase of the print cycle, the return timing pulses 22 have a much higher frequency, as indicated by return pulses 25 in FIG. 2. When the shaft is rotated into the rest position at the end of the print cycle, the slit 15 in the print-off detection plate 12 is in alignment with lamp 13 and light receiving detector 14 and provides a change of state in the print-off signal pulse 23 thereby indicating that the print cycle is completed and that the next print command signal may be applied.

Accordingly, because a second photo detecting assembly or other mechanisms such as a reed switch, microswitch, etc., must be provided to generate the print-off signal, the size and cost of such printers is thereby increased. Although the second photo detecting assembly or other like mechanisms have been removed and replaced by a mono-stable multivibrator having a time interval which supplies a print-off signal after a fixed time, such interval must be fixed with a large enough margin to take into account variations in the mechanical movement and ambient temperature characteristics thereby clearly increasing the amount of time which each printing cycle requires.

Figure 3:
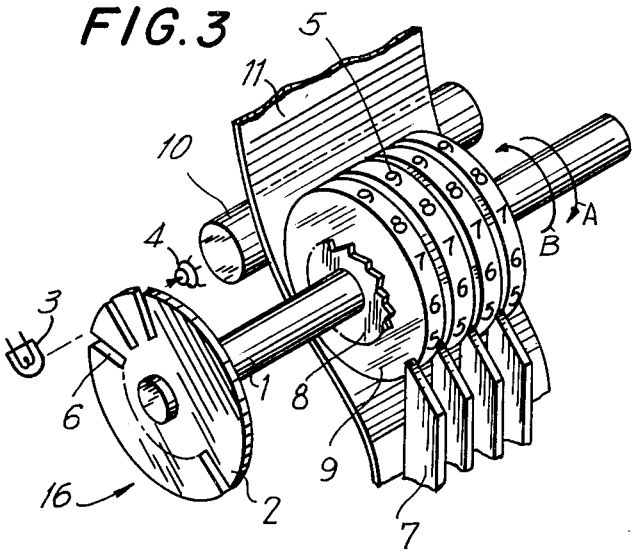
FIG. 3 is a perspective view of a printer constructed in accordance with the instant invention.
Figure 5:
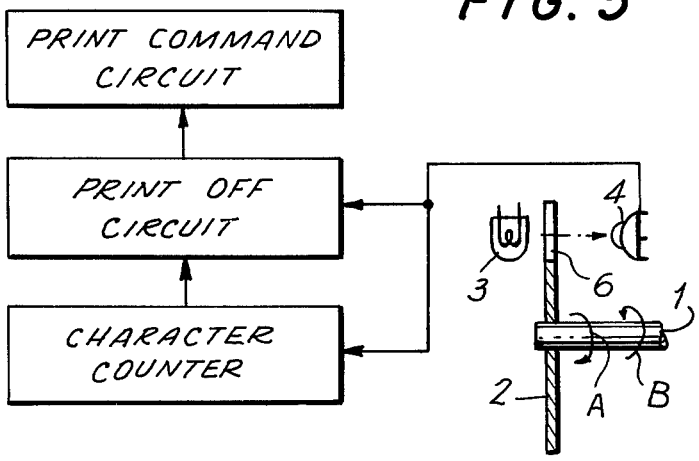
FIG. 5 is a circuit diagram of a circuit adapted to produce the print cycle illustrated in FIG. 4.
Figure 4:
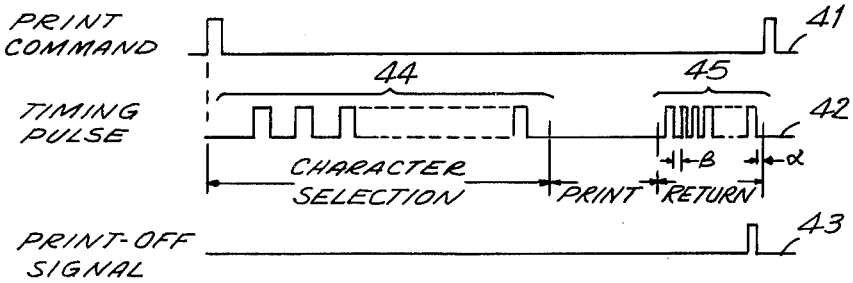
FIG. 4 is a wave diagram of the signals utilized to effect the print cycle in the printer illustrated in FIG. 3.

Reference is now made to FIGS. 3 through 5 wherein a printer constructed in accordance with the instant invention is depicted, like reference numerals being utilized to denote like elements. As is clearly illustrated, the print-off detection assembly has been removed from the printer mechanism. Instead, in response to the print command signal, the timing pulses 42 including the character selection pulses 44 and the return timing pulses 45 are provided by the character selection photo detection assembly 16 and the last pulse of the return timing pulses 45 is utilized as a print-off signal.

As illustrated in FIG. 5, the last return pulse 45 of of the timing pulses 42 is utilized as a print-off signal to be applied to a print command circuit to indicate the completion of the printing cycle. In a first embodiment the character counter counts the number of character selection pulses 44 during the character selection phase of the print cycle and then further counts the number of return pulses during the return phase of the print cycle and upon the coincidence in the number of pulses counted in each phase supplies a print-off signal in response to the trailing edge of the last pulse of the return pulses 45. Accordingly, a print-off signal will be applied to the print command circuit upon the character counter counting the same number of return timing pulses as character selection pulses.

Alternatively, the print-off circuit includes electronic circuitry capable of measuring a time interval $\alpha$ larger than the time $\beta$ between any two return pulses and in response to the sensing of such a time interval, generating a print-off signal to the print command circuit. Of course, in such an embodiment, the character counter would supply a signal to the print-off circuit to activate same after the character selection phase since the time interval $\alpha$ would be shorter than the time between each of the character selection pulses 44.

It is noted, that by utilizing the last of the return timing pulses 45 as the print-off signal, the print-off signal is responsive to the motion of the spring and character shaft. Due to rapid rotation of the detecting plate 2 by the spring, full shaping of the signals supplied by the character selector detecting assembly is not achieved. However, use of the time interval measuring circuit to measure the time interval $\alpha$, will cause a print-off signal to be generated even though definite and well formed pulses are not obtained.

It is noted, that the shorter the time from the termination of the return phase of the print cycle to the beginning application of the next print command signal, the more lines of print per unit can be printed. Thus, the instant invention is advantageous since the time from the return phase to the next print command can be minimized and is only related to the variations in the mechanical elements of the printer and the factors surrounding same such as ambient temperature, etc.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a printer including a character ring having print characters circumferentially disposed thereabout, said print characters being selectively positioned in a print position by rotation of said character ring in a first rotational direction from a rest position to a print position, the improvement comprising a detection means for generating character selection timing pulses representative of each rotational position of said character ring, said detection means further producing return timing pulses in response to the rotation of said character ring in a second rotational direction from said print position to said rest position, and print-off producing means for sensing the last said return timing pulses and in response thereto producing a print-off pulse.

2. A printer as claimed in claim 1, wherein said print-off pulse producing means include circuit means for sensing a time interval greater than the time interval between each said return pulse, said time interval sensing means producing said print-off pulse in response to no return pulses being applied thereto for the duration of said interval.

3. A printer as claimed in claim 1, wherein said print-off signal means includes means adapted to count each of said character selection timing pulses and each of said return timing pulses and in response to counting the same number of each of said pulses producing said print-off signal.

4. A printer as claimed in claim 3, wherein said counting means is a character counter.

* * * * *